US005471375A

United States Patent [19]

Lau

[11] Patent Number: 5,471,375

[45] Date of Patent: Nov. 28, 1995

[54] FLUORESCENT LIGHT BALLAST LAMP MOUNTING SOCKET CONSTRUCTION

[76] Inventor: Kenneth Lau, 4327 Point Reyes Ct., Carlsbad, Calif. 92008

[21] Appl. No.: 188,807

[22] Filed: Jan. 31, 1994

Related U.S. Application Data

[63] Continuation-in-part of Ser. No. 832,988, Feb. 10, 1992.

[51] Int. Cl.[6] ..... F21S 5/00; F21V 29/00

[52] U.S. Cl. ..... 363/260; 362/216; 362/221; 362/294

[58] Field of Search ..... 362/216, 221, 362/225, 260, 294; 315/58, 62, 71; 313/318, 493, 318.01, 318.02, 318.09, 318.12

[56] References Cited

U.S. PATENT DOCUMENTS

| | | | |
|---|---|---|---|
| 2,817,004 | 12/1957 | Baumgartner et al. | 362/216 |
| 4,109,303 | 8/1978 | Hetherington | 362/216 |
| 4,386,296 | 5/1983 | Beck | 315/62 |
| 4,549,251 | 10/1985 | Chapman et al. | 362/216 |

FOREIGN PATENT DOCUMENTS

| | | | |
|---|---|---|---|
| 2146755 | 4/1985 | United Kingdom | 362/225 |
| 2180988 | 4/1987 | United Kingdom | 362/217 |

*Primary Examiner*—Stephen F. Husar
*Assistant Examiner*—Y. Quach
*Attorney, Agent, or Firm*—Ralph S. Branscomb

[57] ABSTRACT

A mounting base assembly is adapted to mount a specific commercially available fluorescent lamp. The unit is characterized by the design of the ballast housing to fit inside the space defined by the fluorescent lamp internally of the surrounding, somewhat annular fluorescent tube so that the light fixture can be made as compact as possible. The base assembly is also constructed to minimize the possibility of mounting under- or over-wattage fluorescent lamps.

14 Claims, 8 Drawing Sheets

FLUORESCENT LIGHT BALLAST LAMP MOUNTING SOCKET CONSTRUCTION

This application is a continuation-in-part of application Ser. No. 832,988 filed Feb. 10, 1992.

BACKGROUND OF THE INVENTION

It is a known fact that on the average fluorescent lights consume up to 75% less energy than incandescent lamps with the same light output. The EPA estimates that if Americans were to convert from incandescent lamps to fluorescent, the energy saved would be equivalent to removing ⅓ of all automobiles from the road. Fluorescent lights also have substantially longer service lives, up to ten times the lifespan of incandescent bulbs, and new generations of highly efficient fluorescents with excellent color rendition are being produced in various compact shapes and sizes.

Aside from the considerably higher initial cost, two major hurdles lie in the path of converting incandescent fixtures to fluorescent. First, the fluorescent tube (discharge tube) produces a limited amount of light per linear unit of length, requiring it to be many times longer than the overall length of an incandescent bulb. This requires inventive folding and convoluting to even approach conforming to the same space requirements as incandescents. Some incandescent installations are still too confined to permit upgrading.

Second, the weight and bulk of the conventional magnetic, transformer-style ballast makes it difficult for fluorescents to compete in some installations with the light-weight, compact incandescent. Conventional ballasts have copper wire transformer coils which make it very heavy in addition to being bulky. These limitations have made it difficult to provide a screw-in fluorescent fixture that could be used in a normal incandescent light bulb socket.

With the development of electronic ballasts to replace magnetic, the weight and bulk limitations formerly dictated by the coiled wire ballasts have been partially eliminated. Besides the weight and overall volume restrictions of the ballast, magnetic ballasts also must be provided as a single mass since the coils must be as close as possible to one another for the most efficient transforming. The newer electronic ballasts on the other hand may be arranged and configured to suit more desirable spatial distributions conforming more closely to the space available.

In 1981, Thorn EMI lighting of the United Kingdom launched its 16 watt compact fluorescent lamp line called the 2D lamp series. This lamp is shaped like two letter D's back-to-back, and is somewhat butterfly-like in appearance. The 2D series has been developed from 1981 to the present to include different sizes and different power level fluorescent lamps. The initial 16 watt lamp has been expanded to a line of five different wattage levels ranging from 10 watts to 38 watts.

In addition to the variations in wattage rating and size, some of the 2D lamps incorporate the starter within the lamp support housing, requiring only two pins to connect to a support socket. Others of the lamps do not include the starter and have a 4-prong plug structure for coupling to a mating socket. Because all 4-pin plugs are identical, and all of the 2-pin plugs are identical, with current lamp mounts there is the distinct possibility that lamps of the incorrect wattage will be plugged into available lamp bases. Although there may be coincidental limitations on the available volume due to surrounding structure which would make impossible mistaken use of a large tube in a socket for a small tube, the converse would always be possible. The 10-watt unit will fit all of the other sizes, and would be either immediately burned out, or have a very limited lifespan, if inadvertently plugged into a 38-watt socket.

In addition, although the 2D series is a good, compact design, typically the corresponding base assemblies are not. 2-D goes a long way toward minimizing the limitations inherent in fluorescent tubes, but there has been a failure to maximize the potential of the lamp by distributing the ballast into available, non-invasive space. A typical 2D base assembly, which is described in the specification, requires a space that is of a depth more than twice the depth of the lamp itself to accommodate the bulky ballast.

There is a need for a lamp base assembly which is specifically tailored to the 2D lamp series and which manifests multiple improvements over the prior art lamp base assemblies in both weight and volume and eliminates the possibility of inadvertent power mismatches.

SUMMARY OF THE INVENTION

The instant invention fulfills the above stated needs by providing a fluorescent lamp base assembly, which includes both a mounting socket and ballast, which is designed such that the ballast lies within the planar space defined by the extremities of the lamp itself. The ballast occupies this available space, and is spaced with an air gap from the fluorescent tube support housing and disposed on the opposite side of the support housing from the hot cathodes mounted in the ends of the discharge tube.

The ballast is provided with tube slots tailored to receive the tube support arms which are part of all 2D series lamps. This not only enables the ballast to wrap around the arms and fill the inter-tube, planar, space, but also serves as a first safety against installation of the wrong fluorescent lamp size. Further keying means are provided so that it is impossible to insert lamps of the wrong size, and for lamps of the same physical size which come in two different power ratings, a dual-level power output switch is built into the base assembly.

DETAILED DESCRIPTION OF THE PREFERRED EMBODIMENTS

Figure 1:
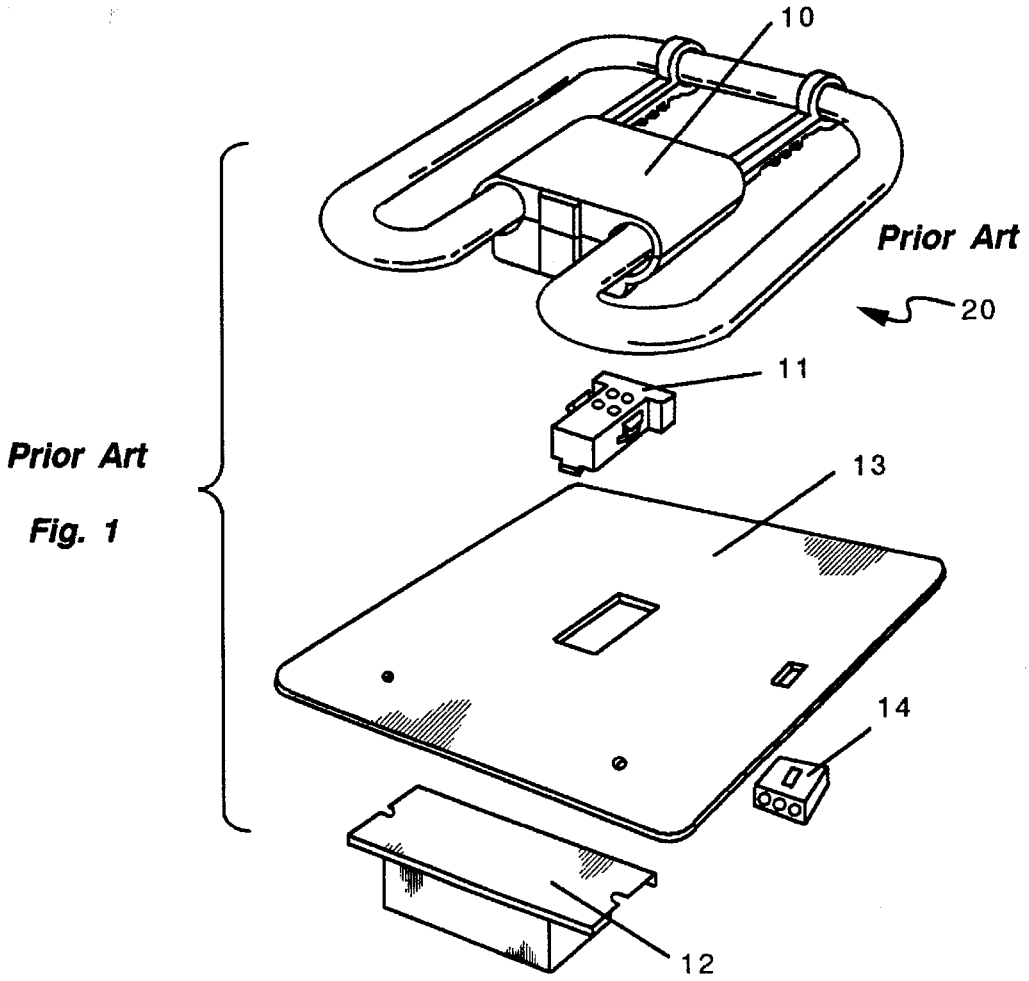
Prior Art Fig. 1
FIG. 1 is an exploded view of the prior art lamp and its mounting base assembly and ballast enclosure.

FIG. 1 illustrates the basic prior art device, in which the lamp support housing 10 of the 2D fluorescent lamp 20 mounts into the 4-pin socket openings of the lamp holder base assembly 11, which is snapped into the mounting tray 13. The ballast 12 is mounted underneath the tray, or it connects to the socket 11 through the connector 14.

Figure 2:
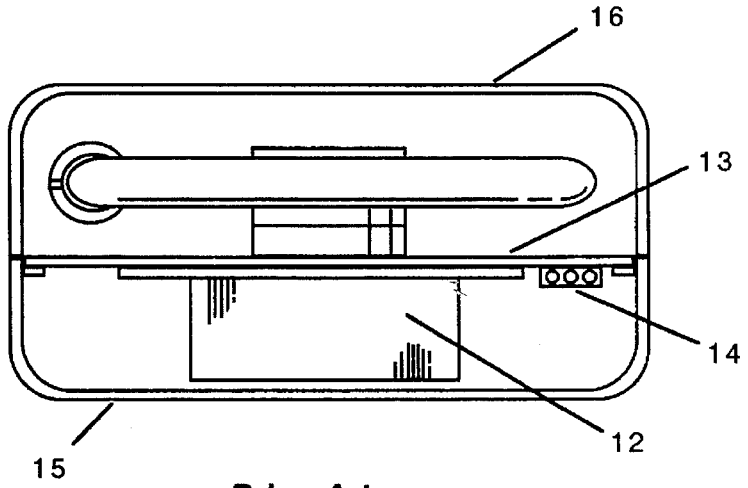
Prior Art Fig. 2
FIG. 2 is a section taken through a fully assembled prior art lamp in an enclosing housing for use as an overhead or wall mount.

FIG. 2 illustrates the prior art in its fully assembled form, in which the structure described with reference to FIG. 1 is incorporated in an enclosure 15, with a diffusion surface 16 on one side of the enclosure. The type of light fixture shown in FIG. 2 is a wall mount, ceiling mount, or recessed embodiment, contrasted with the incandescent lamp socket adaptor 17 shown in FIG. 3, which has a threaded incandescent lamp-type base 18.

Figure 3:
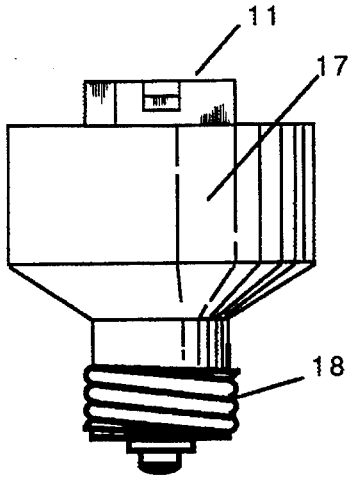
Prior Art Fig. 3
FIG. 3 is a prior art incandescent bulb socket adaptor.

The two configurations of fluorescent light fixtures shown in FIGS. 2 and 3 are representative of most fluorescent light fixtures which have been re-designed in recent years to replace incandescent lights. The 4-foot and 8-foot tubes will not fit within many spaces illuminated by incandescents. The FIG. 2 embodiment is fairly compact, but would ordinarily be a permanent mount, whereas the embodiment of FIG. 3 can be screwed into any existing incandescent lamp socket with adequate clearance.

Figure 4:
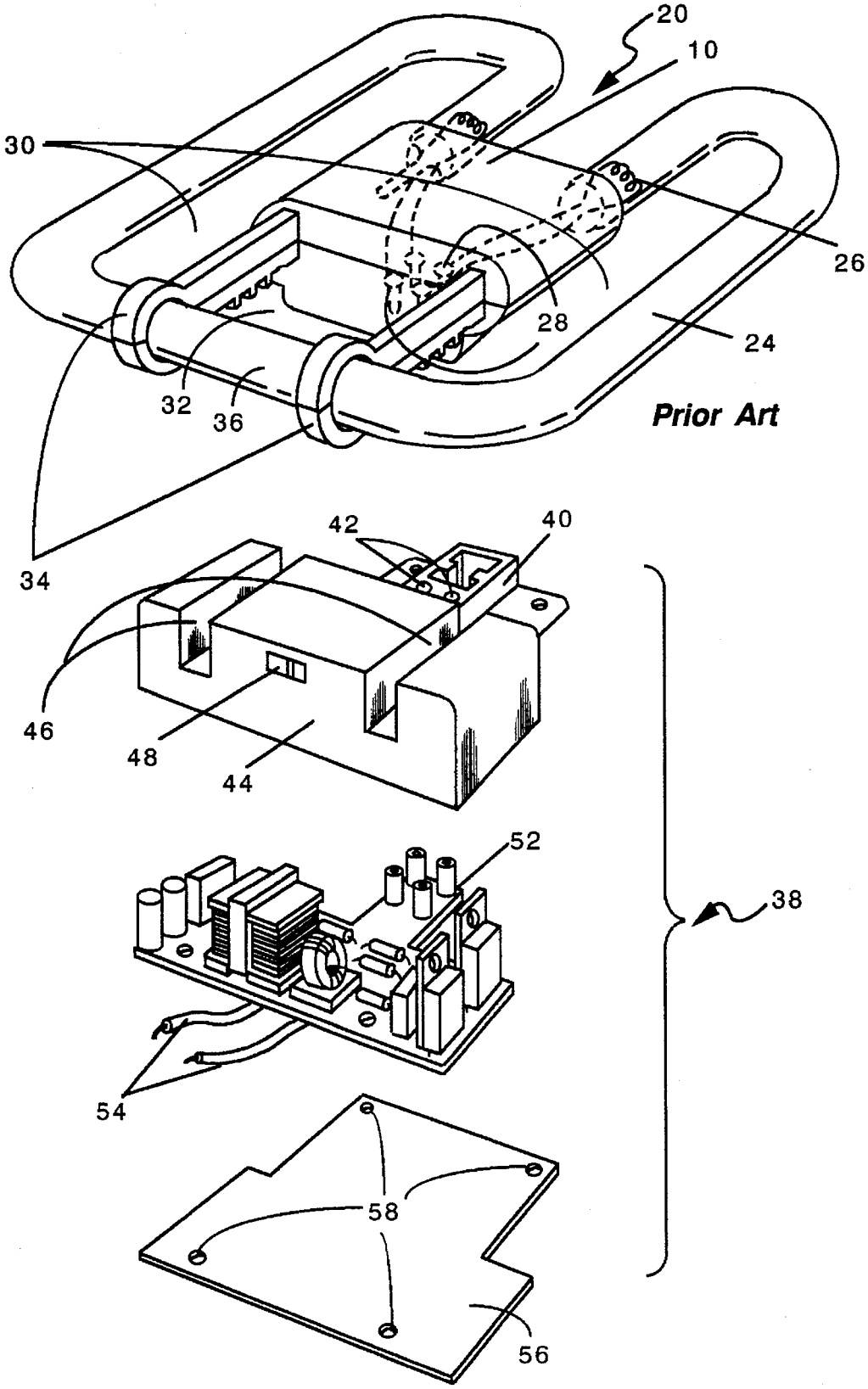
FIG. 4 is an exploded perspective view of a first embodiment of my invention in which the ballast and mounting socket of the base assembly are provided in an integral housing.

FIG. 4 illustrates the first embodiment of the invention, which provides a ballast for, and supports, the 2D lamp fixture generally indicated at 20. The lamp fixture has as its core the lamp support housing 10, shown centrally in FIG. 4, which receives the ends of the discharge tube 24 in one side. The ends which are received in the lamp support housing house the discharge tube cathodes 26, which are connected through the ends of the tube to connector pins 28, which project downwardly from the central portion of the lamp housing to define a mechanical and electrical attachment to a base.

Although theoretically it would be possible to incorporate the electronic ballast directly inside the lamp support housing, which is produced integrally with the discharge tube, this is impractical due to the fact that the long so-called "exhaust tube" extends from one of the tube ends into the lamp housing. This tube must be kept cool, which is why it is isolated in the housing away from the hot cathodes 26, which are outside the housing. If the ballast were inside the lamp housing, the heat it produces would severely reduce the life of the lamp. This construction would also require that the ballast be discarded with the tube every time the latter is replaced.

So although suggestions have been made to incorporate the ballast into the lamp support housing along with the starter, this is not a practical proposition.

The 2D lamps are characterized by their planar construction which defines a general planar space bounded at top and bottom by the upper and lower perimeter of the tube. The planar space thus defined includes open spaces 30 inside the side lobes of the discharge tube and a more central space 32 on the opposite side of the lamp support housing from the cathode-mounting ends of the discharge tube. All of the 2D fixtures are characterized by the discharge tube support arms 34 which extend between the lamp support housing and a central, straight section 36 of the discharge tube.

The lamp base assembly 38 which comprises the instant invention is shown FIG. 4, and includes the base assembly socket 40 with pin holes 42 and a ballast housing, which together With the socket housing define the base assembly housing 44.

The base assembly housing has a pair of parallel slots 46. These slots are dimensioned and configured to receive the extended support arms 34, enabling the base assembly housing to be in essence wrapped around the support arms such that the base assembly structure falls principally within the open area 32 of the overall tube-defined planar space.

The spacing of the slots 46 dictates that a single size of the 2D lamp, and only that size, will be accepted by the base assembly. The base assembly is provided in three different sizes to accommodate the three different 2D sizes in the series. Alternatively, the assembly housing can be made small enough to fit between the support arms in the space 32, so that the slots would not be necessary.

However, two of these sizes are provided in two different wattage ratings. Although the ratings of the two lamps within each size category do not deviate as much as the ratings between lamps of different physical size, they differ enough that the higher-rated lamp will be noticeably underlit and off-color when powered at the lower wattage level, and conversely the lower-wattage lamp would be overdriven and will die young.

To accommodate dual wattage ratings in the same tube size, high-low voltage selector switch 48 or similar device such as a jumper is provided in the ballast housing 50. The ballast housing would ordinarily indicate the 28/38-watt alternatives beside the switch.

Incorporated within the ballast housing is the ballast 52, which connects to an external AC or DC power supply through wires 54, and to the pins of the fluorescent lamp through the pin socket 40. The ballast housing could have ventilation slots, or use potting compound or other heat sink material.

All of the base assembly structure is mounted to the underlying plate or tray 56 through mounting holes 58, corresponding with similar mounting holes in the base assembly housing, and also providing for mounting to a wall or ceiling surface.

Several facts should be noted with regard to the FIG. 4 embodiment. First, it will be seen that the ballast housing 50 is positioned on the opposite side of the lamp support housing 10 from the hot ends of the discharge tube 24. It is also positioned relative to the lamp socket 40 so that it is spaced away from the housing, providing an air space for ventilation and insulation purposes. An air gap separates the ballast from the tube for thermal isolation.

Figure 5:
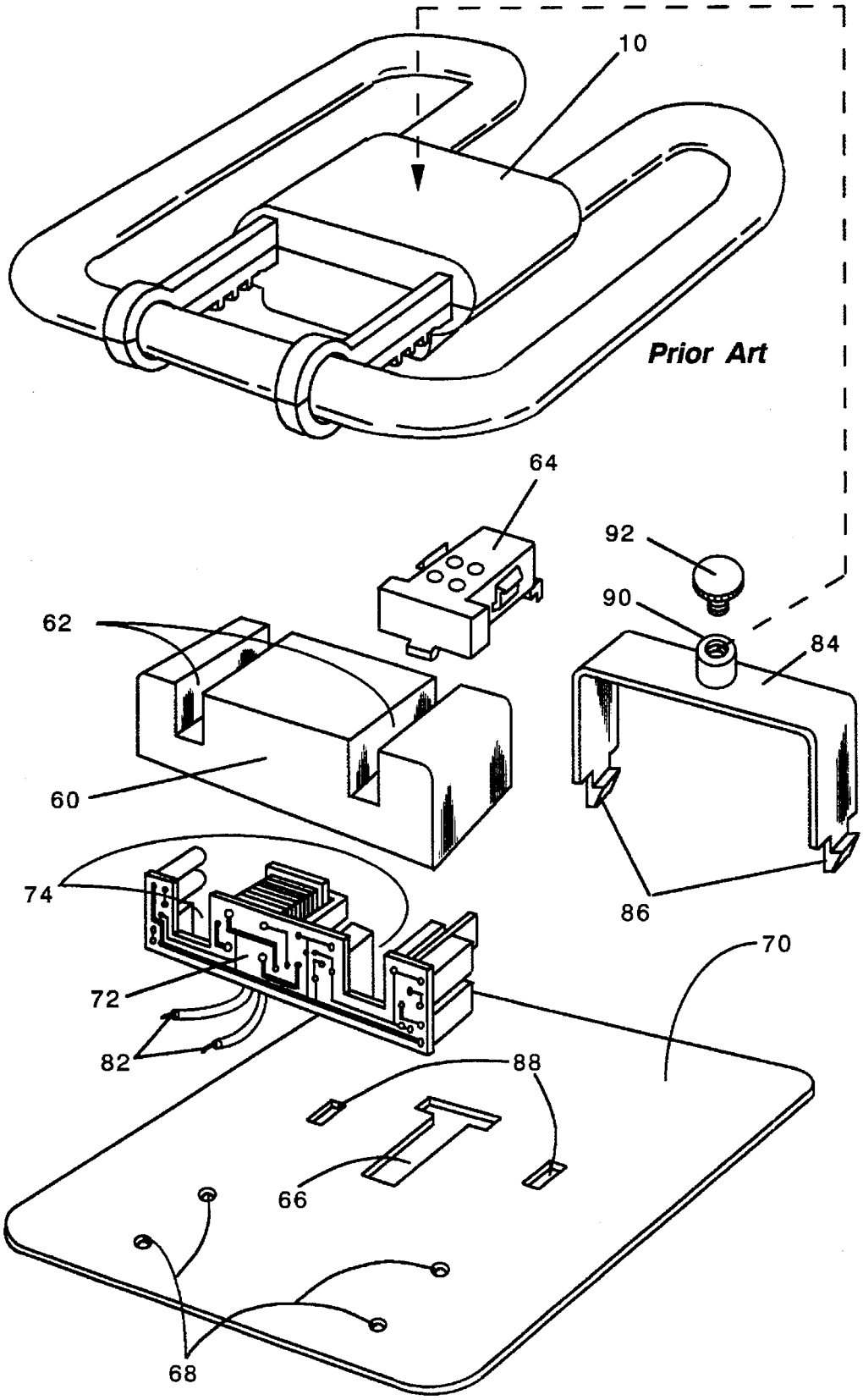
FIG. 5 is an exploded perspective view of a second embodiment of my invention in which the mounting socket and the ballast housing are separated, but fairly closely spaced nonetheless, being maintained in proper relative position by an underlying reflective mounting tray.

The embodiment of FIG. 5 is very similar to that of FIG. 4, differing primarily in the mounting technique, the fact that the ballast housing is separate from the lamp socket rather than being integral, and the use of an upright PC board rather than the flat PC board of the FIG. 4 embodiment. The two different embodiments might also accommodate two different lamp sizes.

With reference to FIG. 5, ballast housing 60 is provided with slots 62, similar to slots 46 of FIG. 4. The ballast housing is separate from the socket element 64, which is snapped into the socket-mounting opening 66 while the ballast housing is screwed or bolted to or through some of the holes 68 of mounting tray 70, which may also double as a reflector.

The upright circuit board 72 in this embodiment is E-shaped, with deep-cut slots 74 to accommodate the slots 62 of the enclosing housing 60. The perpendicularly-mounted elements of the ballast circuitry are shown extending out from the E-shaped circuit board. Unshown wires 80 extend from the ballast to the pin connectors of the base assembly socket, and wires 82 are connected to AC or DC power.

To hold the fixture together, a mounting strap 84 is provided with snap-in detents 86 which snap through slotted openings 88 in the mounting tray 70, to securely hold the lamp support housing 10 against the socket 64. The mounting strap also has an accessory mounting socket 90 to which a lamp shade or diffuser may be mounted. A typical lamp shade-retaining nut is shown at 92, other attachment techniques being possible. FIG. 5 represents a wall- or ceiling-mounted fixture.

Figure 6:
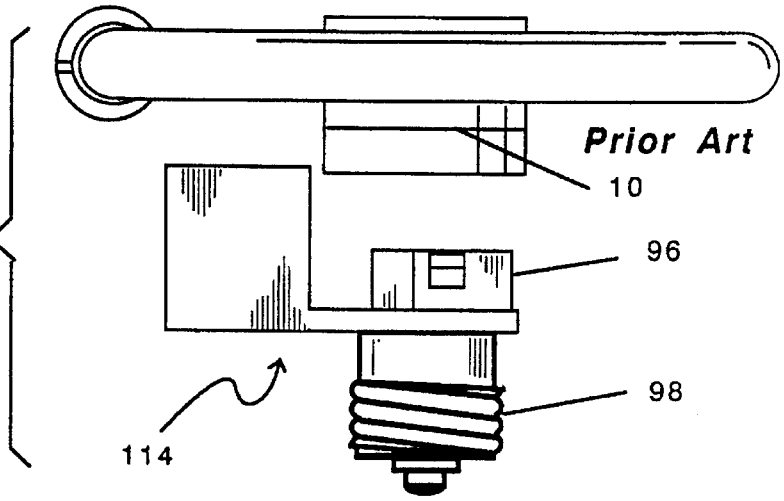
FIG. 6 is an exploded side elevation view of an incandescent lamp with another modification of the invention in which it incorporates a threaded incandescent bulb socket adaptor.

In FIG. 6, the lamp socket/mount 96 is similar in overall construction, at least regarding the spacing of critical parts and surfaces, to the embodiments of FIGS. 4 and 5. However, this embodiment is designed to replace incandescent lamps, and mounts a threaded incandescent lamp base coupling 98. In this embodiment, the ballast housing fits completely within the space 32 between the discharge support arms 34.

Figure 7:
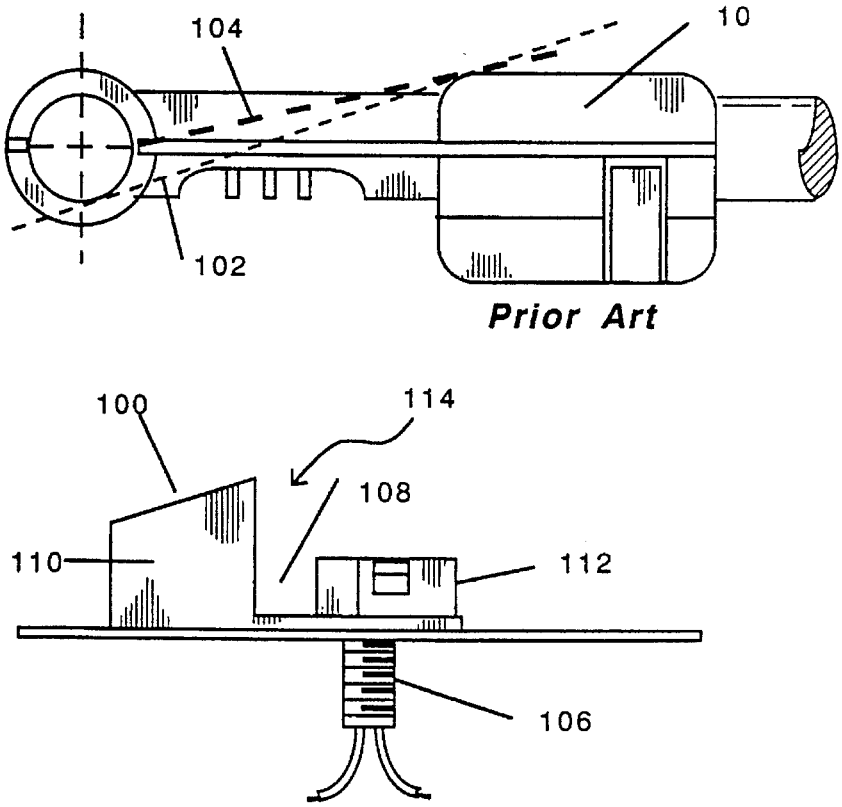
FIG. 7 is an exploded elevation view of a modification of the basic arrangement of FIG. 6 but using a chamfered-topped ballast housing and a utility mounting.

The embodiment of FIG. 6, or any of the embodiments for that matter, would cast a slight shadow due to the interposition of the ballast housing into the fan of light from the length of the discharge tube adjacent to ballast housing. To minimize shadowing, the top surface 100 of the ballast housing should be chamfered as shown in FIG. 7 so that it lies along the dotted line 102 shown in FIG. 7, or slightly flatter even, as indicated by the line 104. The surface 100 could and should be reflective to act as a reflector for the lamp, to which end it need not be flat, but could be parabolic or of any other shape that the particular installation suggests.

This configuration is shown in FIG. 7 in conjunction with a base assembly having a threaded shaft 106 for mounting into an electrical box or other roughed-out fixture. This figure shows clearly the air gap 108 between the ballast housing 110 and the socket 112 and the lamp support housing 10, when the lamp is inserted.

Figure 8:
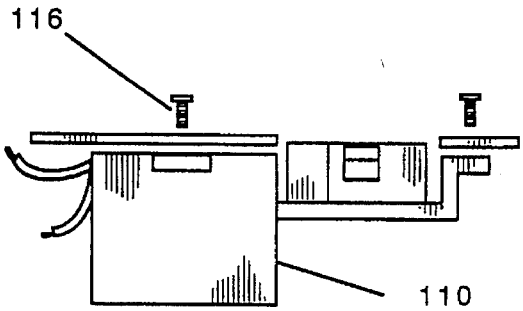
FIG. 8 is a diagrammatic representation of a possible recessed mounting configuration.

FIG. 8 is not itself a separate embodiment, but is illustrative of the possibility of recessing the electronics of the invention flush with the surface of a wall or ceiling, so that only the socket 112 is accessible for insertion of the prongs from the lamp. The housing 114 of this structure is retained in place by screws 116.

Figure 9:
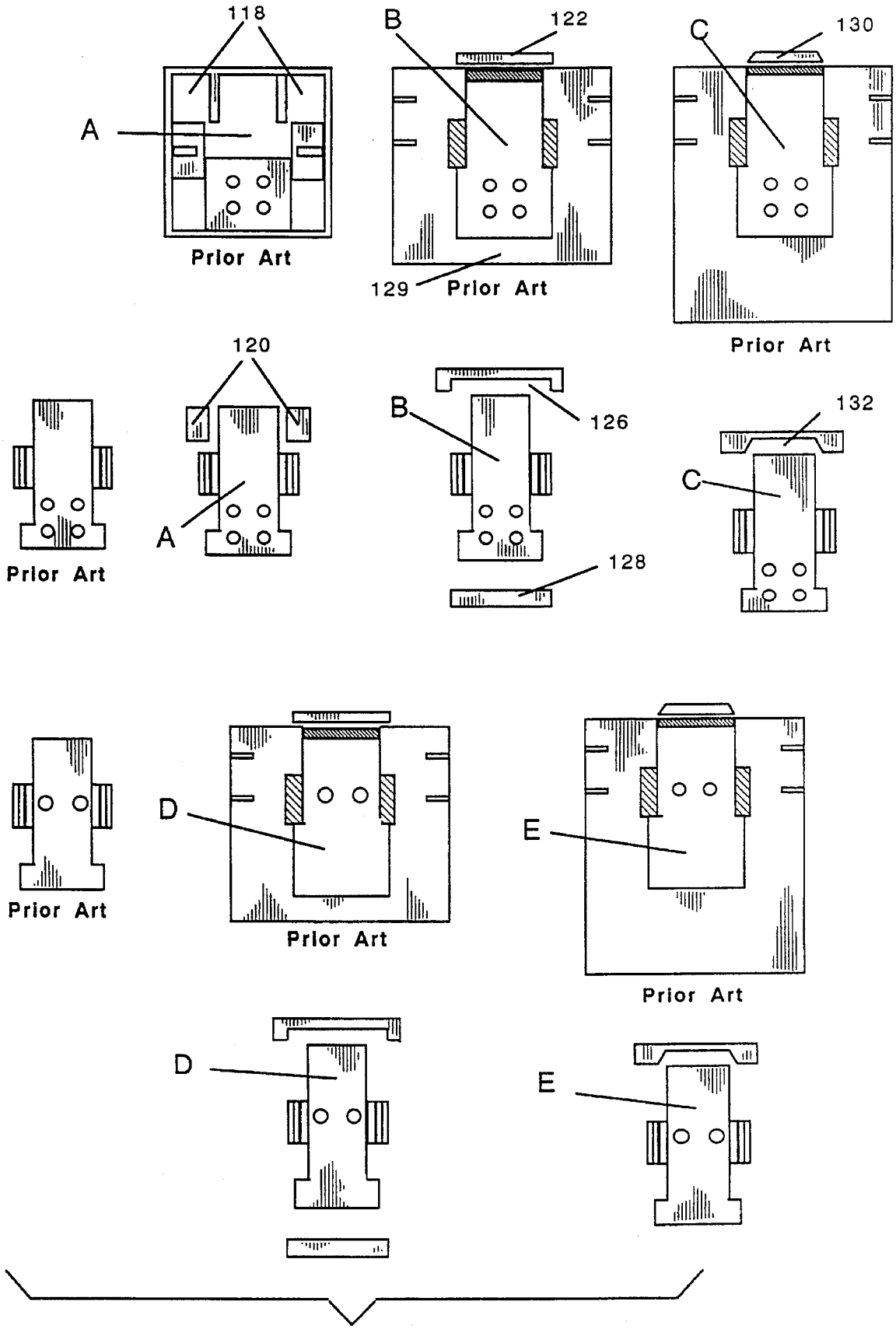
FIG. 9 illustrates the lamp support housing structure from the projecting pin side in row one for the three sizes with the mating socket structure of the instant invention aligned below the tube support housing in the second row, with the third and fourth rows being comparable to the first and second rows but relating to 2-pin configurations rather than 4-pins.
Figure 10:
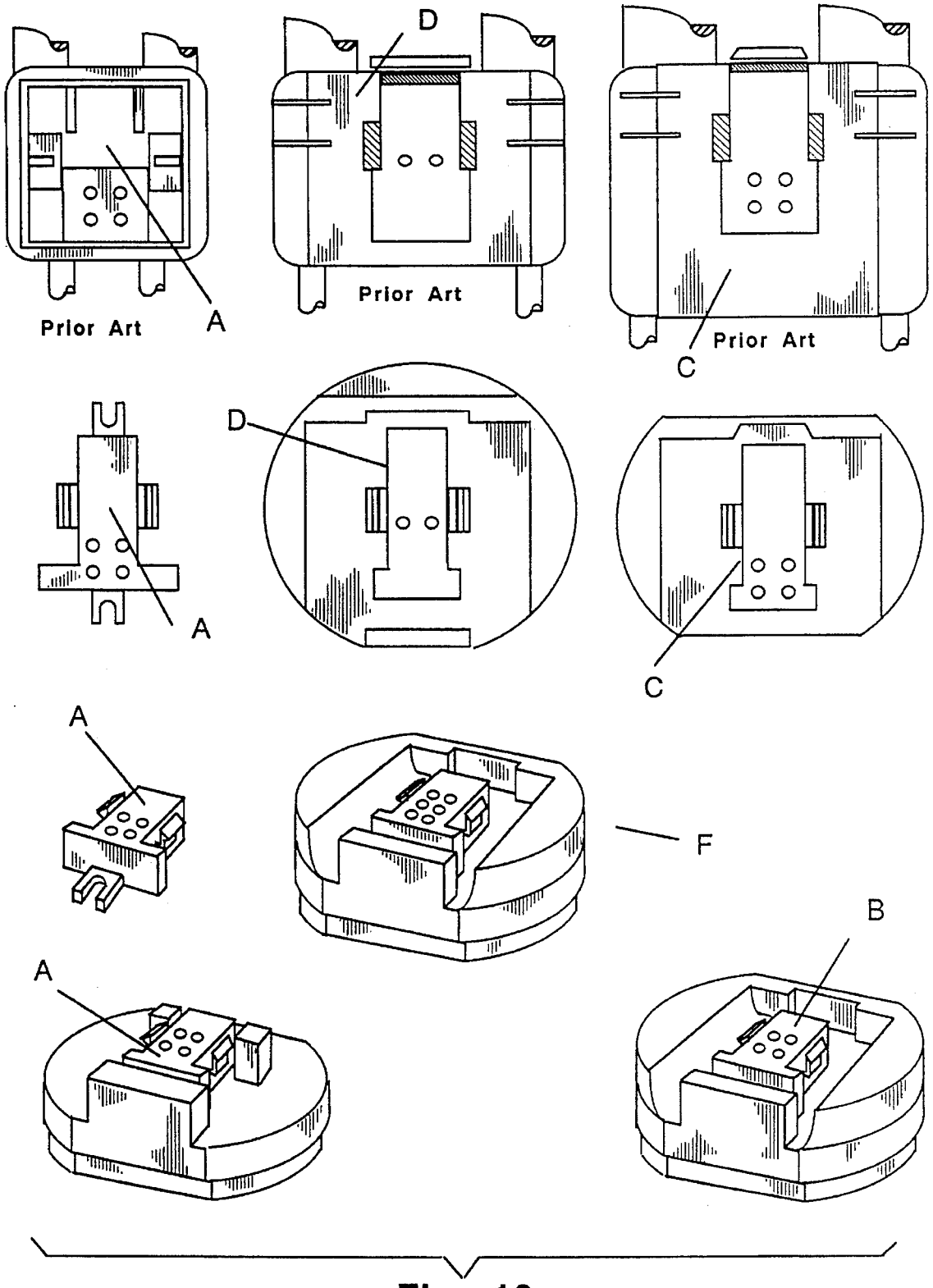
FIG. 10 illustrates the various bases and tube housings of FIG. 9 in more detail; and, FIGS. 11, 12 and 13 and 14 illustrate three modified base styles with optional features.
Figure 11:
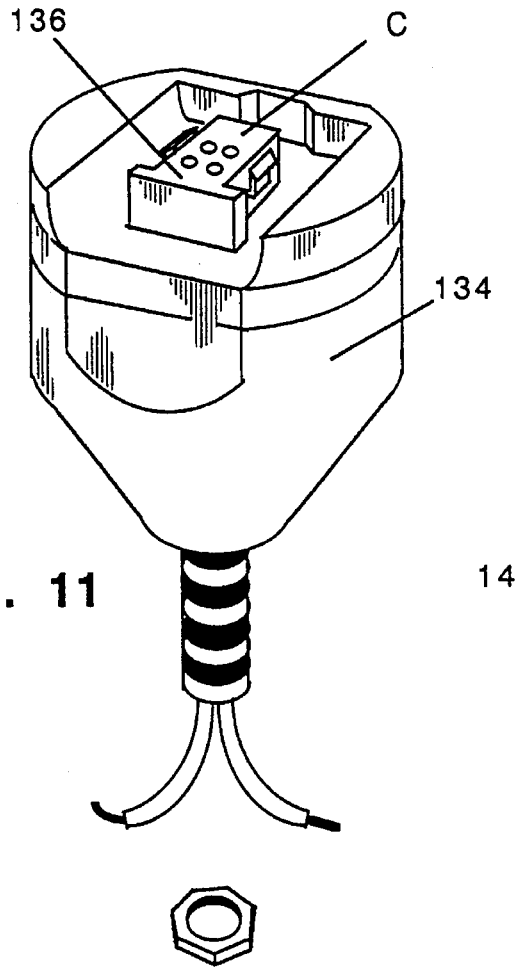
Figure 12:
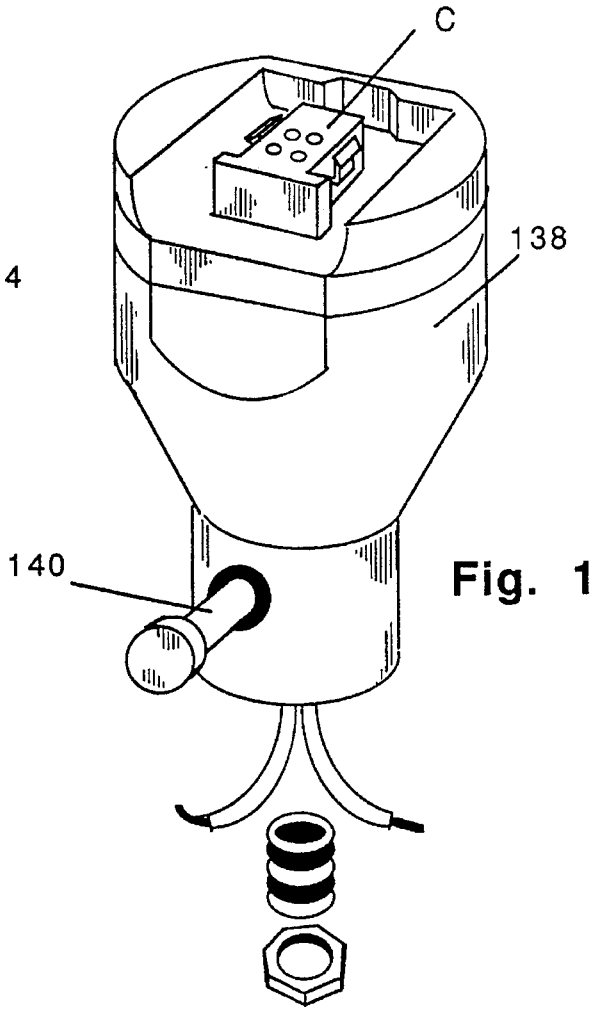

FIG. 9 illustrates diagrammatically, in the first row, the orientation of the parts of several commercially available models of the lamp support housing 10 as seen from the bottom, and in the second row the top view of the mating structure of the corresponding socket assembly is illustrated. The upper two rows of figures are representative of the 4-pin models of the 2D layout, while the lower two rows of figures pertain to the 2-pin models. In addition to other element numbers, mating bases and lamp housings are given corresponding letters A–E for quick reference, so that all the "A" parts are 10 watt, four-prong models, "B" represents 16 w/21 w lamps, and so forth. This scheme is carried forth to FIG. 10 as well, which shows various other renditions of the base and lamp housing coupling. The power levels of the lamps that fit the various configurations are as follows:

| STYLE | # PINS | POWER RATING |
|---|---|---|
| A | 4-PIN | 10 Watts |
| B | 4-PIN | 16W.& 21 W. |
| C | 4-PIN | 28W.& 38W. |
| D | 2-PIN | 16W.& 21W. |
| E | 2-PIN | 28W.& 38W. |
| F | 6-PIN | 16W.& 21W. (combination of B & D) |
| G | 6-PIN | 28W.& 38W. (combination of C & E) |

6-pin sockets are combined 2- and 4-pin sockets of the same power rating which can alternatively take either pin configuration can be seen that the general theme is the mating of an elongated convex member extending from one side of the coupling, to a concavity on the other side which provides clearance for the convex member so that the two parts can seat together and function as a lamp, but only if the member and concavity match.

The 10 watt 4-pin lamp A has a pair of spaces 118 which are not present in the other 4-pin units. For this reason, blocks 120 are incorporated into the 10 watt, 4-pin base unit which must interfit with the spaces 118 and will effectively preclude the mounting of any of the other sizes into this socket.

Similarly, 16 watt/21 watt model B has a projection 122 and a projection 124, so that the space 126 and projection 128, respectively, in the associated base socket will interfit and accommodate this structure of the lamp support housing while precluding installation of any other size. Comparable structure in the 28-watt/38-watt model C utilizes a projection 130 which is part of the lamp support housing, and a space 132 which will accept the projection 130 as the key means to eliminate the other sizes.

The same structure is carried through to the 2-pin units D and E shown in the lower two rows of FIG. 9. These units are shown in more detail in FIG. 10. Each lamp size has unique structure that is taken advantage of to define exclusive mating key structure in the respective base.

Turning now to FIGS. 11 through 14, these figures disclose features of the bulb socket-type base as opposed to the wall or ceiling flat-mount unit of FIGS. 4 & 5. The base 134 shown in FIG. 11 defines a C-style socket 136 and mounts permanently in a lamp stem or other location rather than screwing into an incandescent socket. It accommodates either 28- or 38-watt lamps and therefore should have an internal setting or a toggle, not shown, to select the appropriate voltage level. A very similar base 138 in FIG. 12 mounts the same 28/38-watt lamp and has a switch 140 which controls power and has plural power settings to either operate lamps of different power ratings or to dim higher voltage lamps.

Figure 13:
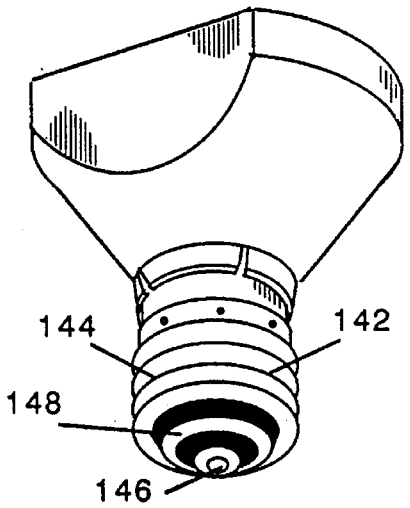

FIG. 13 illustrates the threaded coupler 142 of a 3-way base which engages in the socket of a standard 3-way incandescent lamp. The threaded sides 144 form one contact and alternative contacts 146 and 148 are energized one at a time or both together for three possible light levels. This is common in incandescents but not in fluorescents.

Figure 14:
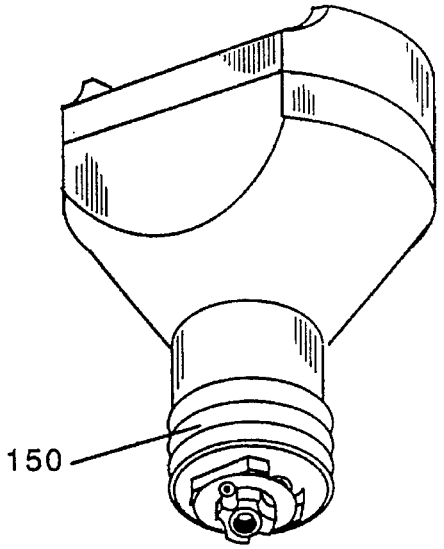
Figure 15:
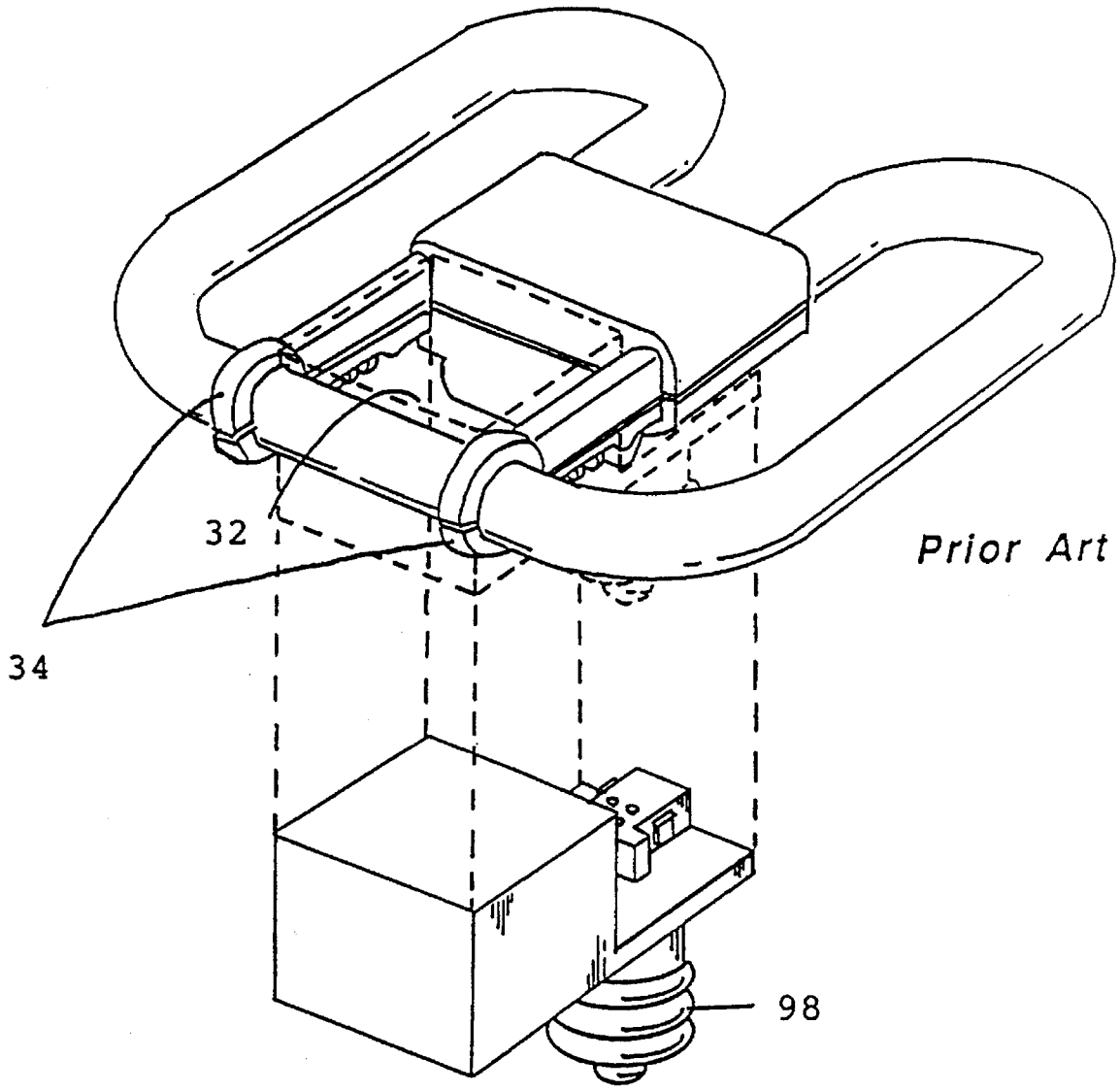
FIG. 15 is a perspective view of the embodiment of FIG. 6 illustrating the manner in which the ballast substantially fits within the inner loop of the lamp tube and support arms.

Lastly, the base 150 of FIG. 14 is a ratchet-mounted base which rotates against friction in one direction and will not rotate in the other direction. It is screwed into the socket against friction so that it slips at a certain degree of resistance and will not tighten further. The removal direction engages the ratchet so that the base will not become irreversibly lodged in the socket. This arrangement permits rotation of the lamp to a more ideal orientation after mounting. Unlike bulbs, fluorescent tubes designed for incandescent sockets are not radially symmetrical about their rotational axes and may seat at less than optimal orientations without the ratchet base. Many one-way mechanisms could be incorporated into the coupling. Also, the rachet base could be a three-way coupler as shown in FIG. 13 in addition to being a ratchet mount.

The unit as thus described and claimed moves advances fluorescent lamp fixture design into forms which more closely duplicate and more easily replace incandescent fixtures, taking advantage of the already compact design of the 2D lamp series to optimize compactness. Features common to incandescents such as 3-way brightness control and alternate lamp power choices for the same mounting ease the trauma of switching for those wedded to particular features. By providing the size-coded keying system, the 2D series fluorescent lamp mounting base assembly unit of the instant disclosure sets forth the optimum possible mounting environment for these lamps.

It is hereby claimed:

1. For a fluorescent lamp having a fluorescent discharge tube substantially defining a planar space and delineating a substantially open area lying within said planar space, and having a lamp support housing into which the ends of said discharge tube enter and are fixedly mounted, one end of said discharge tube having an exhaust tube extending therefrom inside said lamp support housing, said housing also defining a mechanical and electrical coupling, a space-saving ballast-housing base assembly comprising:

(a) a socket for engaging said coupling and electrically coupling with same;

(b) a ballast housing housing a ballast electrically connected to said socket and lying adjacent to said socket in relation thereto such that when said lamp is mounted in said socket, said ballast housing lies substantially entirely within said substantially open area within said planar space, whereby said ballast is substantially confined to within said planar space defined by said lamp, and is separate from the lamp support housing to avoid the heating of the ballast by the exhaust tube;

(c) said discharge tube ends being inserted and fixed into one side of said lamp support housing and said ballast housing being disposed on a side of said lamp support housing opposite said one side to isolate said ballast from the heat of said ends of said discharge tube;

(d) said discharge tube of said fluorescent lamp extending from said one side of said lamp support housing and looping around same in spaced relation thereto to define a generally straight central segment spaced on the opposite side of said lamp support housing from said tube ends;

(e) said fluorescent lamp having a pair of tube support arms extending from said lamp support housing to said central segment and supportively engaging same; and, (f) said ballast housing defining two spaced slots to receive said arms such that said ballast housing nestles around said arms in said planar space.

2. A base assembly according to claim 1 wherein said ballast is dimensioned, shaped and positioned to lie substantially between said tube support arms and be confined within said planar space.

3. A base assembly according to claim 4 wherein said ballast housing has a top and said spaced slots are entrant from the top of said ballast housing and said socket engages said coupling from underneath same.

4. A base assembly according to claim 3 wherein said fluorescent lamp is produced in one of three different physical sizes and including structure on said base assembly keyed to the physical configuration of the coupling and lamp support housing of a particular size of fluorescent lamp such that lamps of other sizes than said particular size have said structure on their respective base assemblies which will physically conflict with the respective coupling and lamp support housing of lamps not of said particular size and will not engage in the socket of the base assembly.

5. A base assembly according to claim 4 wherein said physical configuration of the coupling and lamp support housing is unique to a particular power rating at which the respective lamp is rated, and comprises a concavity and said structure on said base assembly comprises an elongated convex member extending therefrom cooperative with said concavity to provide clearance for said convex member when said lamp and base assembly are coupled.

6. A base assembly according to claim 3 wherein said fluorescent lamp is produced in models having a plurality of alternative power ratings but of the same physical size, said ballast alternatively outputs power to accommodate each of said plurality of power ratings, and including an externally accessible switch to select the power rating of one of said plurality of power ratings.

7. A base assembly according to claim 1 and including a mounting tray to which said socket, ballast housing, and ballast are mounted, and further including a mounting strap which passes across the lamp support housing and engages same to said base assembly, said mounting strap further including attachment means to facilitate the mounting of light diffusers or light shades to said base assembly.

8. A base assembly according to claim 1 wherein aid lamp support housing has a top-adjacent edge closest to said ballast housing and said central segment of said discharge tube has a bottom edge, and said ballast housing has a top surface that is chamfered at an angle substantially conforming to a projected plane extending from the top-adjacent edge of said lamp support housing to the bottom edge of the central segment of said discharge tube to minimize the blocking of otherwise available light from said tube by said ballast housing.

9. A base assembly according to claim 8 wherein said top surface is reflective and serves as a reflector for said lamp.

10. A base assembly according to claim 1 wherein said ballast housing and socket define an integral base assembly unit mounting an incandescent lamp-type coupling.

11. A base assembly according to claim 10 wherein said incandescent coupling defines a longitudinal axis and is rotational about said axis relative to said socket such that said lamp is rotationally independent from said incandescent coupling for final orientation.

12. A base assembly according to claim 11 wherein said incandescent coupling has an outer portion and a unidirectional mechanism rotationally mounting same to the rest of said incandescent coupling such that said base assembly unit will rotate against friction in an incandescent socket in the installation direction and lock in the other direction to permit adjusting the orientation of said lamp after installation.

13. A base assembly according to claim 1 wherein said base assembly includes a three-way power adaptor enabling same to be used in a conventional three-way incandescent socket.

14. A base assembly according to claim 1 wherein aid ballast housing and socket define an integral base assembly unit mounting a threaded shaft for mounting into an electrical box or other roughed-out fixture.

* * * * *